United States Patent [19]

Graham

[11] Patent Number: 4,524,484

[45] Date of Patent: Jun. 25, 1985

[54] EXTENSION HANDLE HAVING COOPERATING MALE AND FEMALE LOCKING SLEEVES

[75] Inventor: John W. Graham, Simpsonville, S.C.

[73] Assignee: Swiss-Tex, Incorporated, Piedmont, S.C.

[21] Appl. No.: 504,627

[22] Filed: Jun. 15, 1983

[51] Int. Cl.[3] ..... B25G 1/04

[52] U.S. Cl. ..... 16/115; 15/143 B; 15/144 B; 16/DIG. 39; 16/DIG. 41; 403/104; 403/290

[58] Field of Search ..... 16/114 R, 115, DIG. 39, 16/DIG. 41; 403/104, 290; 15/143 B, 144 B; 74/544, 546, 551.3, 551.4; 285/322, 323

[56] References Cited

U.S. PATENT DOCUMENTS

| | | | |
|---|---|---|---|
| 1,463,084 | 7/1923 | Hudson | 403/290 X |
| 2,595,597 | 5/1952 | Morseth | 403/104 X |
| 3,321,863 | 5/1967 | Maxam, Jr. | 403/290 X |
| 3,380,097 | 4/1968 | Pharris | 15/145 |
| 3,489,451 | 1/1970 | Guckenberger | 294/19 |
| 4,095,826 | 6/1978 | Borradori | 285/330 |
| 4,182,364 | 1/1980 | Gilbert et al. | 137/426 |
| 4,250,348 | 2/1981 | Kitagawa | 174/65 |
| 4,277,197 | 7/1981 | Bingham | 403/104 |
| 4,325,157 | 4/1982 | Balint et al. | 16/115 |
| 4,378,172 | 3/1983 | Groschupp | 403/104 |

*Primary Examiner*—Fred Silverberg

*Attorney, Agent, or Firm*—Bell, Seltzer, Park & Gibson

[57] ABSTRACT

First and second tubular pole members are formed of rolled sheet metal material and provided with a lock seam defining a reinforcing rib extending inwardly and longitudinally along each pole member. The second pole member has a smaller external diameter than the internal diameter of the first pole member and is telescopically received within and spaced inwardly of the inwardly extending reinforcing rib of the first pole member. The light-weight construction of the pole members permits easy manipulation of the extension handle and the lock seam reinforcing rib provides sufficient rigidity and strength to prevent lateral bending of the pole members, even when the extension handle is fully extended. A locking device is provided for permitting telescopic adjustment of the length of the extension handle and for maintaining the extension handle in the adjusted position. The locking device includes threadably interconnected first and second tubular members which are molded of plastic for economical reasons. The first tubular member is maintained in one end of the first pole member by a pressed fit and a longitudinal slot straddles the lock seam on the inner surface of the first pole member to prevent rotation of the first tubular member.

4 Claims, 6 Drawing Figures

EXTENSION HANDLE HAVING COOPERATING MALE AND FEMALE LOCKING SLEEVES

FIELD OF THE INVENTION

This invention relates generally to an extension handle and more particularly to a light-weight extension handle which can be readily varied in length for manipulating various types of tools, such as a window washing pad or the like.

BACKGROUND OF THE INVENTION

Various types of extension handles have been provided for permitting a person to reach normally inaccessible locations with a tool, such as a window washing pad, paint roller and the like. These prior types of extension handles usually include a pair of seamless tubular pole members of the butt weld type with one pole member being telescopically adjustable within the other pole member and some type of locking means is provided for holding the pole members in length-adjusted position. The locking means includes a male locking member threadably engaged by a female locking member and the female locking member is rotated to cause locking fingers on the male locking member to move into and out of gripping engagement with the telescopically adjustable pole. U.S. Pat. No. 3,380,097 illustrates such a locking means with the male locking member being fixed to the pole member by either a pair of locking pawls engaging slots in the pole member or by a second set of locking fingers.

The use of butt weld type tubular pole members of heavy gauge or thick material adds to the cost of producing the extension handle. The use of heavy gauge butt weld type tubular pole members also adds to the weight and makes the tool difficult to manipulate, particularly when the extension handle is in the fully extended position. Also, the provision of locking pawls or an additional set of locking fingers for fixing the male locking member in position in one end of one of the pole members adds to the cost of producing the extension handle.

SUMMARY OF THE INVENTION

With the foregoing in mind, it is an object of the present invention to provide a light-weight extension handle in which first and second telescoping pole members are interconnected by locking means for maintaining the pole members in adjusted position. The pole members are of the "lock seam" type and are formed of relatively thin rolled sheet metal with the edges joined by multiple layers of material extending inwardly and longitudinally thereof. The lock seam defines a reinforcing rib which provides longitudinal strength to resist transverse bending of the pole members. The lock seam extends into a longitudinal slot in one end of a first tubular locking member and prevents rotation thereof when the first locking member is pressed into the end of the first pole member.

The second pole member has a smaller external diameter than the internal diameter of the first pole member and has an inner end portion telescopically received within and spaced inwardly of the inwardly extending lock seam of the first pole member. The outwardly extending portion of the second pole member is provided with means for supporting the tool thereon, such as a window washing pad of the type illustrated in the drawings. Locking means is carried by the one end of the first pole member for permitting telescopic adjustment of the second pole member within the first pole member and for maintaining the second pole member in adjusted position.

The locking means includes a first tubular or male locking member having an internal bore therein for closely surrounding the outside diameter of the second pole member and for slidably and guidingly receiving the inner end portion of the second pole member therein. External threads extend around a medial portion of the first tubular member and one end portion is positioned within one end of the first pole member and has an external diameter providing a snug or pressed fit therein. A longitudinal slot is formed in the one end portion of the first tubular member for surrounding the lock seam of the first pole member when the first tubular member is pressed into the end thereof. A gripping portion is provided at the other end of the first tubular member and includes a plurality of longitudinally extending slots defining a plurality of spaced-apart gripping and locking fingers which closely surround the outside diameter of the second pole member. The outer end portion of the gripping portion is beveled on its exterior surface to define a cam surface on the outer ends of the gripping fingers.

A second tubular or female locking member is provided with internal threads adapted to threadably engage and surround the external threads on the first tubular member. The outer end of the first tubular member is internally beveled to define a mating cam surface for engaging the cam surface and inwardly compressing the gripping fingers when the first tubular member is threaded onto the second tubular member to force the gripping fingers into tight gripping engagement with the outside diameter of the second pole member and to lock the same in adjusted position. To change the length of the extension handle, the first tubular member is rotated to relieve the inward pressure of the cam means against the gripping fingers and the second pole member is then free to slide through the bore in the first tubular member to a new length-adjusted position.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
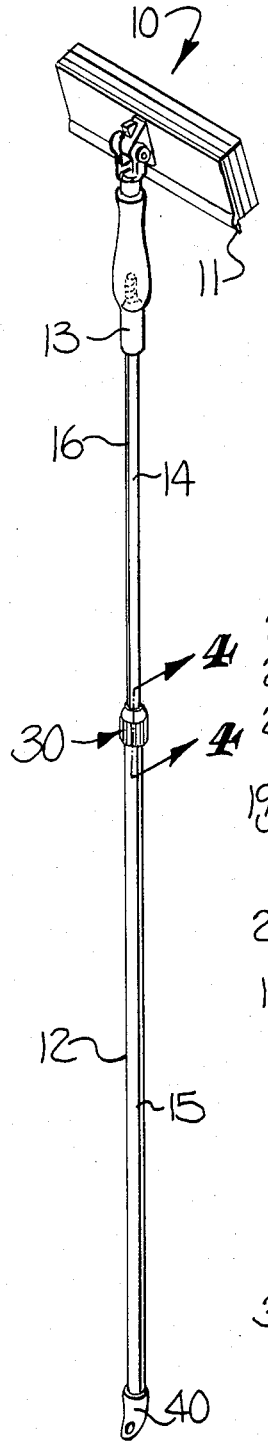
FIG. 1 is a perspective elevational view of one side of the extension handle of the present invention and illustrating the same supporting a window washing pad on one end thereof.
Figure 2:
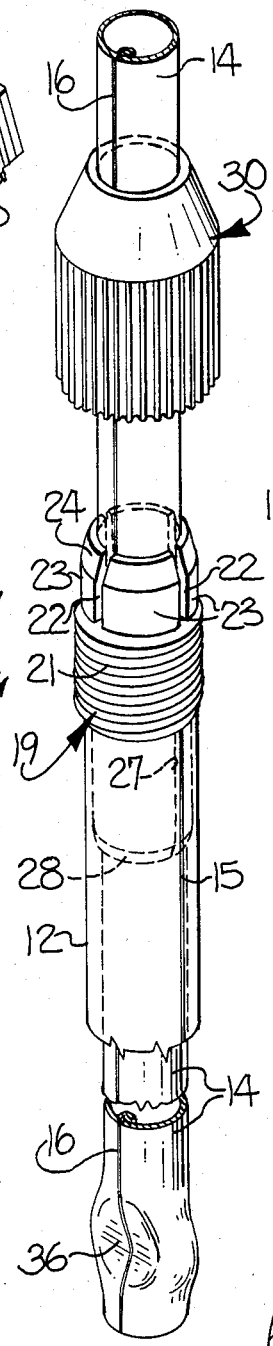
FIG. 2 is an enlarged fragmentary view of the juncture of the first and second pole members with the second tubular locking member being raised above the first tubular locking member to illustrate the manner in which the gripping fingers surround and engage the second pole member.

The present light-weight extension handle is illustrated in FIG. 1 as supporting a window washing pad, broadly indicated at 10, and including a squeegee blade 11. However, it is to be understood that the present extension handle may be used for supporting other types of tools thereon, such as a paint roller, brush or the like. The handle includes respective first and second telescopically connected tubular pole members 12, 14. The handle of the window washing pad 10 is supported on the outer end of the second tubular pole member 14 by means of a support member 13 fixed on the pole member 14 and including male threads adapted to be threaded into the handle of the window washing pad 10, as illustrated in FIG. 1.

Figure 4:
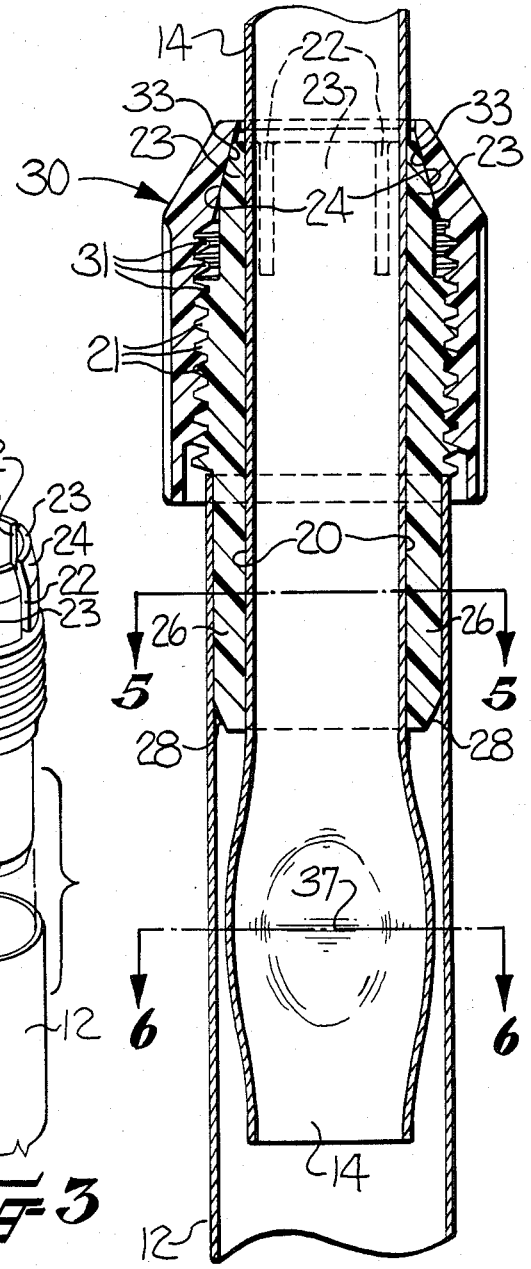
FIG. 4 is an enlarged longitudinal sectional view taken substantially along the line 4—4 in FIG. 1.
Figure 5:
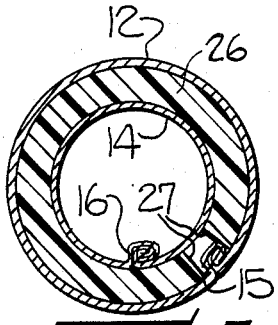
FIG. 5 is a transverse sectional view taken substantially along the line 5—5 in FIG. 4.

Each of the pole members 12, 14 is of the "lock seam" type and is formed of relatively thin sheet metal material formed into a tube with the edges joined by a lock seam of multiple layers of material extending longitudinally of and located on the interior surface thereof. The lock seams define respective reinforcing ribs 15, 16 (FIG. 5) extending inwardly throughout the length thereof so that the outside of each of the pole members 12, 14 is substantially smooth. As shown in FIG. 5, the second pole member 14 has a smaller diameter than the internal diameter of the first pole member 12 so that the inner end portion of the second pole member 14 telescopically fits within and is spaced inwardly of the inwardly extending reinforcing rib 15 of the first pole member 12 when the inner end of the second pole member 14 is positioned inside of the first or inner end of the first pole member 12, as illustrated in FIG. 4.

Locking means is fixed in and carried by the inner end of the first pole member 12 for permitting telescopic adjustment of the length of the extension handle and for maintaining the extension handle in one of a number of extended or retracted adjusted positions. The locking means includes a first tubular or male locking member, broadly indicated at 19, with outer and inner opposed ends and having an internal bore 20 extending throughout the length thereof and slidably and guidingly surrounding the outside diameter of the second pole member 14. The internal bore 20 serves as an elongate bearing guide and maintains longitudinal alignment of the first and second pole members 12, 14 when the locking means is released, in a manner to be presently described.

External threads 21 extend around a medial portion of the first tubular member 19 and a gripping portion is provided at its outer end. The gripping portion includes a plurality of longitudinally extending slots 22 defining a plurality of spaced-apart gripping and locking fingers 23 integrally formed at their inner ends with the outer end portion of the first tubular member 19. The gripping fingers 23 extend outwardly and closely surround the outside diameter of the second pole member 14. The outer end portion of the gripping portion is beveled on its exterior surface to define a cam surface 24 on the outer end portions of each of the gripping fingers 23, for purposes to be presently described.

Figure 3:
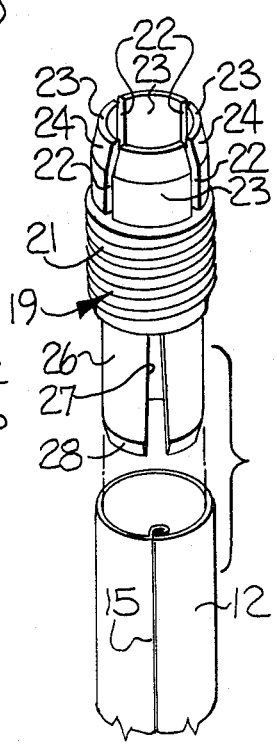
FIG. 3 is an exploded perspective elevational view of the upper end of the first tubular pole member and the first tubular locking member.

A mounting sleeve 26 is integrally formed at its outer end with the inner end of the first tubular member 19 and has an external diameter providing a snug fit in the inner end of the first pole member 12, as by a pressed fit. The outside surface of the mounting sleeve 26 is provided with a longitudinally extending slot 27 (FIG. 3) adapted to receive the reinforcing rib 15 of the first pole member 12 when the mounting sleeve 26 is pressed into the outer end of the first pole member 12. As shown in FIG. 3, the lower or inner end of the slot 27 is wider than the upper or outer end and the inner end of the sleeve 26 is beveled, as indicated at 28 in FIG. 3 so that the free end of the sleeve 26 can be easily pressed into the end of the first pole member 12 with the slot 27 straddling the rib 15 (FIG. 5). When the sleeve 26 is pressed into the first pole member 12, the wider end of the slot 27 narrows and engages opposite sides of the rib 15 and prevents rotation of the first tubular member 19 inside of the first pole member 12.

A second tubular or female locking member, broadly indicated at 30, is provided with internal threads 31 adapted to threadably engage and surround the external threads 21 on the medial portion of the first tubular member 19, as illustrated in FIG. 4. The outer surface of the second tubular member 30 is provided with longitudinally extending ribs to facilitate gripping during rotation of the second tubular member 30 by the hand of the user. An internally beveled portion is provided on the outer end of the second tubular member 30 to define an inwardly tapering cam surface 33 (FIG. 4) for mating engagement with the cam surfaces 24 on the gripping fingers 23 and for inwardly compressing the gripping fingers 23 when the second tubular member 30 is threaded into the first tubular member 19. The cam surface 33 forces the gripping fingers 23 into tight gripping engagement with the outside diameter of the second pole member 14 to lock the same in length-adjusted position.

When the second tubular member 30 is threaded onto the first tubular member 19, as illustrated in FIG. 4, the cam surface 33 maintains the gripping fingers 23 in locking engagement with the outside diameter of the second pole member 14 to maintain the same in longitudinally adjusted position relative to the first pole member 12. In order to adjust the length of the extension handle, the second tubular member 30 is loosened so that the gripping fingers 23 no longer grip the outer surface of the second pole member 14 and the pole member 14 may be moved inwardly or outwardly relative to the pole member 12 to thereby adjust the length of the extension handle. When the desired adjusted length has been attained, the second tubular member 30 is again tightened onto the first tubular member 19 to move the gripping fingers 23 into locking engagement with the outer surface of the pole member 14.

Figure 6:
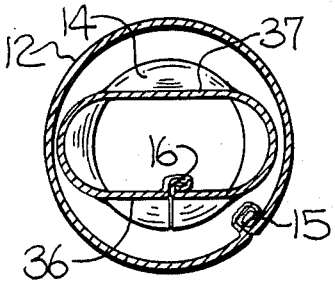
FIG. 6 is a transverse sectional view taken substantially along the line 6—6 in FIG. 4.

In order to prevent the second pole member 14 from being pulled outwardly through the end of the pole member 12, and to also provide a guide along the inner surface of the first pole member 12, opposite sides of the inner end portion of the second pole member 14 are creased or bent inwardly, as indicated at 36, 37. The creases 36, 37 cause the opposed sides of the pole member 14 to be bowed outwardly so that they are positioned close to the inside surface of the first pole member 12, as shown in FIGS. 4 and 6. The outwardly bowed sides of the pole member 12 engage the inner end of the mounting sleeve 26 and prevent the inner end of the second pole member 14 from being pulled outwardly through the bore 20 therein. The outwardly bowed portions of the pole member 14 are at right angles to the creases 36, 37 and act as guides along the inner surface of the pole member 12 when the pole member 14 is moved inwardly and outwardly, and provide a bearing surface, along with the sleeve 26, for the pole member 14. The outwardly bowed portions also limit rotation of the pole member 14 relative to the pole member 12 because they engage opposite sides of the inwardly extending seam or rib 15 on the inner surface of the pole member 12 when the pole member 14 is rotated.

The locking means is illustrated as being formed of molded plastic so that the first tubular member 19 and the second tubular member 30 can be mass produced at a low cost. The provision of the integral mounting sleeve 26 permits the first tubular member 19 to be pressed into the end of the pole member 12 in a quick and efficient manner without requiring any special locking pawls or the like. The integral mounting sleeve 26 also provides an elongated bearing surface, provided by bore 20, and cooperating with the outwardly bowed opposite sides of the pole member 14 which guide the sliding movement of the second pole member 14 into and out of the first pole member 12.

The longitudinal slot 27 in the mounting sleeve 26 straddles the locking and reinforcing rib 15 of the pole member 12 and thereby prevents rotation of the mounting sleeve 26 and the first tubular member 19 when the second tubular member 30 is threaded onto the first tubular member 19 to lock the respective first and second pole members 12, 14 in length-adjusted position. The tubular lock seam pole members 12, 14 can be economically produced and provide light-weight construction with transverse rigidity to prevent bending of the pole members 12, 14, even when in fully extended position. If desired, the free end of the first pole member 12 can be provided with a suitable hanger attachment, as illustrated at 40 in FIG. 1.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An extension handle for manipulating a tool, such as a window washing device, and comprising first and second tubular pole members each formed of relatively thin material formed into a tube with the edges joined by a lock seam of multiple layers of material extending longitudinally of the tube and located on the interior surface thereof, said lock seam defining a reinforcing rib on each of said pole members, said second pole member having a smaller external diameter than the internal diameter of said first pole member and having an inner end portion thereof telescopically received within said first pole member and another portion thereof extending outwardly from one end of said first pole member, and locking means carried by said one end of said first pole member and slidably receiving said second pole member therein for locking said second pole member in one of a number of extended or retracted positions, said locking means comprising a first tubular member including a mounting sleeve on one end and including a beveled free end to aid in inserting and providing a snug fit in said one end of said first pole member, an internal bore extending throughout the length of said first tubular member for slidably and guidingly receiving said second pole member therein, an externally threaded medial portion, and a gripping portion at its other end, said gripping portion having a plurality of longitudinally extending slots defining a plurality of gripping fingers such that said second pole member may be grippingly and lockingly engaged thereby, the outer end portion of said gripping portion being beveled on its exterior surface to define a cam surface, said locking means further comprising a second tubular member being internally threaded to mate with the externally threaded medial portion of said first tubular locking member and having an internally beveled portion at its outer end to define a mating cam surface for the cam surface on said gripping portion of said first locking member, whereby said gripping fingers are inwardly compressed into gripping engagement with said second pole member when said second tubular member is threaded onto said first tubular member to lock said second pole member in adjusted position relative to said first pole member, whereby said gripping fingers are released from gripping engagement with said second pole member when said second tubular member is unthreaded to permit adjustment of said first pole member relative to said second pole member, wherein said mounting sleeve on said one end of said first tubular member is provided with a slot extending longitudinally from the free end thereof and being wider adjacent the free end thereof, the narrower end of said slot being of sufficient width and depth to closely straddle said reinforcing rib extending interiorly of said first pole member, and wherein said mounting sleeve of said first tubular member is pressed into said one end of said first pole member so that said beveled free end causes the wider end of said slot to narrow and engage opposite sides of said reinforcing rib, said longitudinal slot preventing rotation of said first tubular member in said first pole member when said second tubular member is threaded onto said first tubular member.

2. An extension handle according to claim 1 wherein said first tubular member and said second tubular member of said locking means are each formed of molded plastic material.

3. An extension handle according to claim 1 wherein said inner end portion of said second pole member is bowed outwardly to prevent passage of said inner end portion through said bore in said first tubular member and to thereby prevent removal of said second pole member from said first pole member.

4. An extension handle according to claim 3 wherein said outwardly bowed inner end of said second pole member is positioned on opposite sides thereof and is formed by transverse creases at right angles to said outwardly bowed opposite sides.

* * * * *